United States Patent [19]

Lari et al.

[11] Patent Number: 4,974,661

[45] Date of Patent: Dec. 4, 1990

[54] SIDEWALL CONTAINMENT OF LIQUID METAL WITH VERTICAL ALTERNATING MAGNETIC FIELDS

[75] Inventors: Robert J. Lari, Aurora; Walter F. Praeg, Palos Park; Larry R. Turner, Naperville; James E. Battles, Oak Forest; John R. Hull, Hinsdale; Donald M. Rote, Lagrange, all of Ill.

[73] Assignee: Arch Development Corp., Chicago, Ill.

[21] Appl. No.: 408,418

[22] Filed: Sep. 18, 1989

Related U.S. Application Data

[63] Continuation of Ser. No. 207,818, Jun. 17, 1988, abandoned.

[51] Int. Cl.[5] ..... B22D 11/06; B22D 27/02

[52] U.S. Cl. ..... 164/503; 164/428

[58] Field of Search ..... 164/502, 503, 147.1, 164/500, 466, 467, 454, 498, 428, 480; 266/237; 222/594

[56] References Cited

U.S. PATENT DOCUMENTS

| | | | |
|---|---|---|---|
| 4,607,681 | 8/1986 | Tinnes et al. | 164/454 |
| 4,762,653 | 8/1988 | Senillou et al. | 164/503 |

FOREIGN PATENT DOCUMENTS

| | | | |
|---|---|---|---|
| 2396612 | 3/1979 | France | 164/147.1 |
| 57-177861 | 11/1982 | Japan | 164/466 |
| 60-106651 | 6/1985 | Japan | 164/502 |
| 62-104653 | 5/1987 | Japan | 164/480 |

*Primary Examiner*—Kuang Y. Lin

[57] ABSTRACT

An apparatus for containing molten metal using a magnet producing vertical alternating magnetic field positioned adjacent the area in which the molten metal is to be confined. This invention can be adapted particularly to the casting of metal between counter-rotating rollers with the vertical alternating magnetic field used to confine the molten metal at the edges of the rollers. Alternately, the vertical alternating magnetic field can be used as a flow regulator in casting molten metal from an opening in a channel.

4 Claims, 9 Drawing Sheets

SIDEWALL CONTAINMENT OF LIQUID METAL WIHT VERTICAL ALTERNATING MAGNETIC FIELDS

CONTRACTUAL ORIGIN OF THE INVENTION

The United States Government has rights in this invention under Contract No. W-31-109-ENG-39 between the U.S. Department of Energy and Argonne National Laboratory.

This is a continuation of application Ser. No. 207,818 filed June 17, 1988, now abandoned.

BACKGROUND OF THE INVENTION

This invention relates generally to the casting of metal sheets and is particularly directed to the casting of metal sheets between counter rotating rollers.

Steel making occupies a central economic role and represents a significant fraction of the energy consumption of many industrialized nations. The bulk of steel making operations involves the production of steel plate and sheet. Present steel mill practice typically produces thin steel sheets by pouring liquid steel into a mold, whereupon the liquid steel solidifies upon contact with the cold mold surface. The solidified steel leaves the mold either as an ingot or as a continuous slab after it is cooled typically by water circulating within the mold wall during a solidification process. In either case, the solid steel is relatively thick, e.g., 6 inches or greater, and must be subsequently processed to reduce the thickness to the desired value and to improve metallurgical properties. The mold-formed steel is usually characterized by a surface roughened by defects, such as cold folds, liquation, hot tears and the like which result primarily from contact between the mold and the solidifying metallic shell. In addition, the steel ingot or slab thus cast also frequently exhibits considerable alloy segregation in its surface zone due to the initial cooling of the metal surface from the direct application of a coolant. Subsequent fabrication steps, such as rolling, extruding, forging and the like, usually require the scalping of the ingot or slab prior to working to remove both the surface defects as well as the alloy deficient zone adjacent to its surface. These additional steps, of course, increase the complexity and expense of steel production.

Steel slab thickness reduction is accomplished by a rolling mill which is very capital intensive and consumes large amounts of energy. The rolling process therefore contributes substantially to the cost of the steel sheet. In a typical installation, a 10 inch thick steel slab must be manipulated by at least ten rolling machines to reduce its thickness. The rolling mill may extend as much as one-half mile and cost as much as $500 million.

Another approach to forming thin metal sheets involves casting into approximately the final desired shape. Compared to current practice, a large reduction in steel sheet total cost and in the energy required for its production could be achieved if the sheets could be cast in near net shape, i.e. in shape and size closely approximating the final desired product. This would reduce the rolling mill operation and would result in a large savings in energy. There are several technologies currently under development which attempt to achieve these advantages by forming the steel sheets in the casting process. While some of the approaches under investigation use electromagnetic energy, all of these approaches use a solid mold on one or both sides of the sheet. One disadvantage of a solid mold is that contact between the molten metal and the solid mold wall often produce an undesirable surface finish which requires subsequent processing to correct as pointed out above.

Previous inventions have employed electromagnetic fields as a substitute for the solid molds. For example, the use of electromagnetic levitation techniques has been employed for some time in the aluminum industry. The practice there is to use electromagnetic fields to contain the top inch or so of a large, thick ingot. The molten aluminum is cooled and solidified before it touches any mechanical support. Examples of this approach can be found in U.S. Pat. Nos. 3,467,166 to Getselev, 4,161,206 to Yarwood et al, and 4,375,234 to Pryor. Also, U.S. Pat. No. 4,678,024 to Hull, et al, was directed toward use of alternating electromagnetic fields to levitate an entire sheet of molten metal for horizontal casting.

One of the difficulties associated with the use of electromagnetic fields as a substitute for solid wall molds is shaping the electromagnetic field into a uniform plane. Another difficulty with the use of electromagnetic fields for casting molds is that the electromagnetic field required to contain an entire sheet of molten metal is so strong that it causes large eddy currents in the molten metal which heat the metal thereby inhibiting solidification.

Another approach under consideration by the steel industry to reduce processing involves roller casting of sheets of steel. This method was originally invented by H. Bessemer over 100 years ago as described in British patent nos. 11,317 (1847) and 49,053 (1857) and a paper to the Iron and Steel Institutes, U.K. (October 1891). This method produces steel sheets by pouring molten steel between counter rotating twin-rollers. The rollers are separated by a gap. The twin-rollers contain the molten metal between the rollers. Mechanical seals are necessary to contain the molten metal on the ends of the rollers. The rollers can be made from a metal with high thermal conductivity, such as copper or copper alloys, and water cooled in order to solidify the skin of the molten metal before it leaves the gap between the rollers. The metal leaves the rollers in the form of a strip or sheet. This sheet can be further cooled by water or air supplied by jets or other suitable means. This method has the drawback that the mechanical seals used to contain the molten metal at the roller edges are in physical contact with both the rotating rollers and molten metal and therefore subject to wear, leaking, clogging, freezing and large thermal gradients. Furthermore, contact between the mechanical seals and the solidifying metal can cause irregularities along the edges of sheets cast in this manner thereby offsetting the advantages of the roller method.

The present invention overcomes the problems of roller casting and electromagnetic casting with a novel design which features the advantages of both roller casting and electromagnetic casting while overcoming the obstacles associated with both those methods.

Accordingly, it is an object of the present invention to provide an improved method and arrangement for casting thin metal sheets.

It is another object of the present invention to produce thin metal sheets which require little or no subsequent rolling after the sheet is cast.

Yet another object of the present invention is to reduce the cost and complexity of casting thin metal sheets.

A still further object of the present invention is to produce thin metal sheets using less energy.

Still another object of the present invention is to produce a metal product having good metallurgical properties and surface characteristics as it leaves the caster.

Another object of this invention is to provide for continuous roller casting of metal sheets.

It is still another object of this invention to provide containment of a pool of molten metal between twin-roller casters without sidewalls that make physical contact with the rollers.

A further objective of this invention is to prevent a pool of molten metal from flowing out the ends of counter rotating rollers by means of a shaped vertical alternating magnetic field.

A further objective of this invention is to provide an electromagnetic stopper or seal that is capable of preventing or regulating the flow of a molten metal in a horizontal direction.

Another object of the present invention is to cast molten metal in such a manner that the surface skin solidifies with little frictional contact with a mold.

An additional object of the present invention is to electromagnetically cast metal sheet with a minimum of electromagnetic heating of the molten and solid metal.

Another object of the present invention is to provide a system and method which is particularly adapted for the continuous casting of thin sheets of steel.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention provides for containment of a molten metal in a casting process with a vertical alternating magnetic field. In particular, this invention has application to confinement of molten metal at the edges in a roller casting process for producing a continuous metal sheet. The present invention includes a magnet design which produces an alternating vertical magnetic field at the edges of counter rotating rollers between which molten metal can be cast into sheets.

DETAILED DESCRIPTION OF THE INVENTION

The present invention provides a shaped vertical alternating magnetic field to confine a pool of molten metal between the cylindrical surfaces of a pair of rollers as the molten metal is cast into a thin sheet by counter rotation of the rollers which forces the molten metal between them. The vertical alternating magnetic field of the present invention can also be used to prevent or regulate the flow of molten metal from weirs or orifices of other geometries. The pressure, p, exerted by the molten pool of metal consists essentially of ferrostatic pressure $p_h$ and pressure $p_r$ induced by the rollers via the solidifying metal to be cast $$p=p_h+p_r. \tag{1}$$

The magnetic pressure, $p_m$, exerted by the vertical alternating magnetic field, B, must balance or exceed the pressure p from the top of the metal pool to the region where the shell of the metal has solidified sufficiently thick to withstand the pressure p. The magnetic pressure is given by $$p_m=B^2/2u_o \tag{2}$$

where the constant $u_o$ is the permeability of free space.

The ferrostatic pressure $p_h$ exerted by the molten pool of metal increases linearly with increasing downward distance h from the surface of the pool $$ph=g\rho h \tag{3}$$

where $\rho$ is the density of the metal, and g is the acceleration of gravity. The magnetic field required to contain the ferrostatic pressure can be found by equating the magnetic and ferrostatic pressure, $$B=(2u_o\, g\rho h)^{\frac{1}{2}}=k\, h^{\frac{1}{2}} \tag{4}$$

For casting steel k=450 if h is measured in cm and B in gauss.

The roller induced pressure $p_r$ depends on the properties of the metal being cast, the roller diameter and speed and the thickness of the metal strip or sheet being cast. In case of steel sheets, it is estimated that $p_r$ can be 10 to 100 times larger than the hydrostatic pressure $p_h$, i.e. $10p_h<p_r<100\ p_h$.

The frequency of the alternating magnetic field chosen is small as practicable consistent with the distance between the ends of the rollers, typically 60 Hz to 2 KHz.

Figure 1:
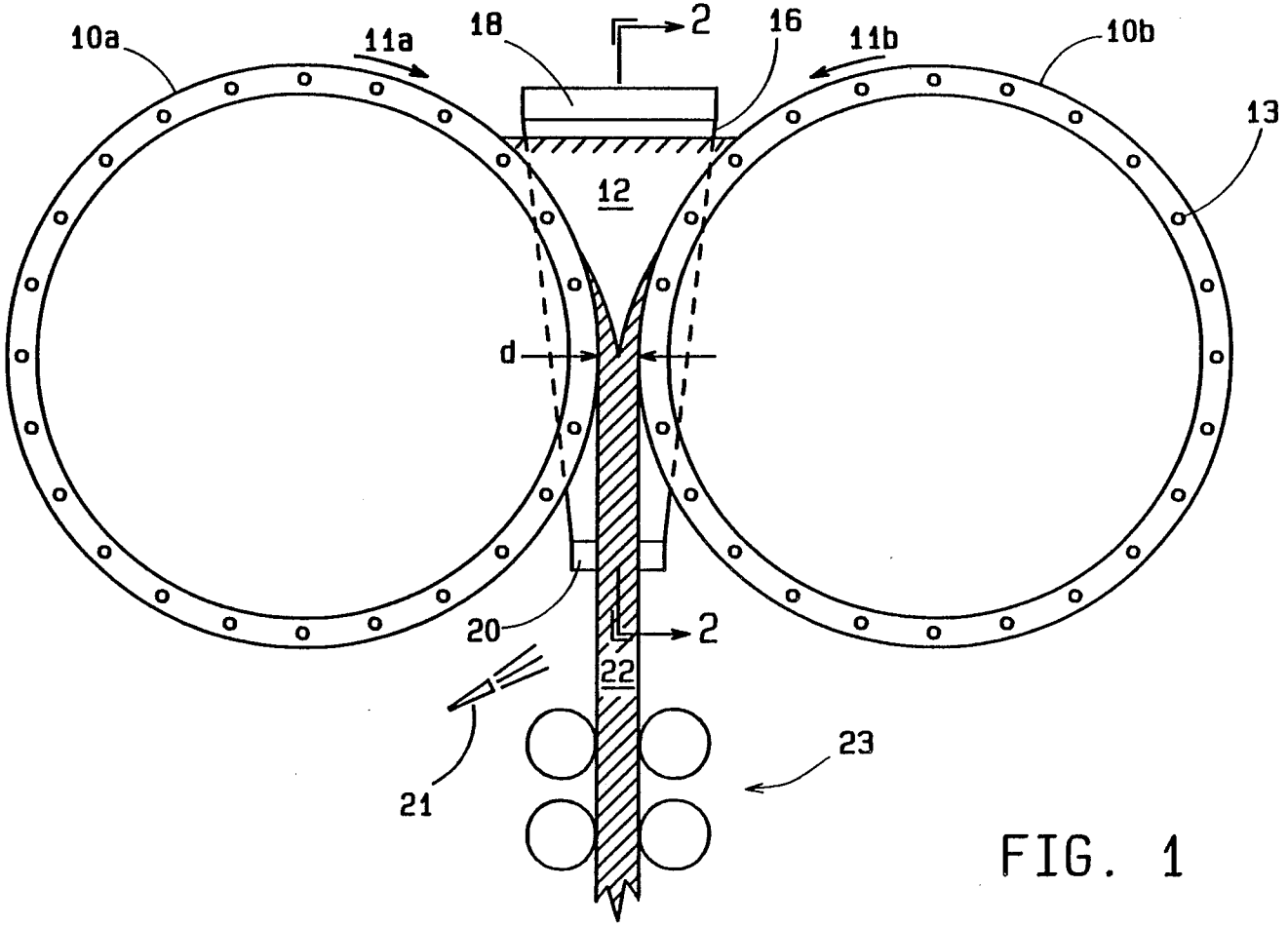
FIG. 1 is a side view of the present invention.

FIG. 1 depicts a side view of the roller casting arrangement of the present invention. A pair of rollers 10*a* and 10*b* are parallel and adjacent to each other and their axes may lie in a horizontal plane so that a molten metal 12 can be contained between them above the point where the rollers are closest together. Rollers 10*a* and 10*b* are separated by a gap, d. Counter rotation of rollers 10*a* and 10*b* (in the direction shown by the arrows 11*a* and 11*b*), operating with gravity, forces the molten metal 12 to flow through the gap between the rollers 10 and out the bottom.

The molten metal is prevented from flowing out from the sides of rollers 10 by magnet 16 (only one shown) that generates a mostly vertical magnetic field which confines the molten metal between the rollers.

Throughout this application references will be made to confinement at one end of a pair of rollers. It should be understood that confinement of molten metal between a pair of rollers requires use of the present invention at both ends.

Rollers 10 include a cooling means 13, as depicted in FIG. 1, to cool and thereby solidify the molten metal as it passes between the rollers. The cooling means 13 may consist of circulating water-cooled channels located inside the surface wall of the roller. The material used for the rollers 10 should have high thermal conductivity so that a cooling means 13, used in conjunction with the rollers, can remove heat from the molten metal thereby facilitating the casting process.

After emerging from rollers 10, the metal has solidified into a sheet 22 (indicated by shading) having a thickness approximately equal to the gap, d, between the rollers 10. Jets 21 located below the rollers 10 are used to further cool the sheet 22 by spraying water or air on it. The solid sheet 22 is supported and carried away from the rollers 10 by mechanical guide 23.

Figure 2:
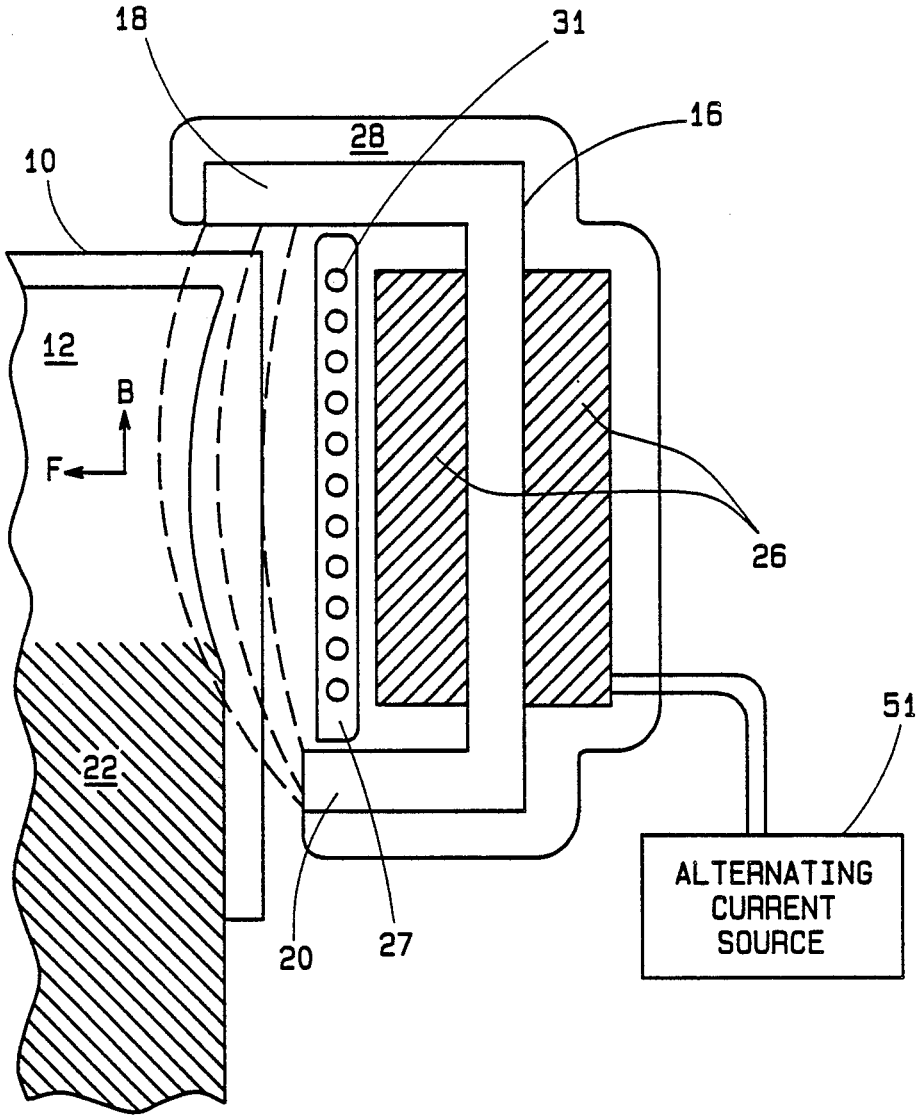
FIG. 2 is a vertical section view of the present invention taken along the center line of FIG. 1.
Figure 3:
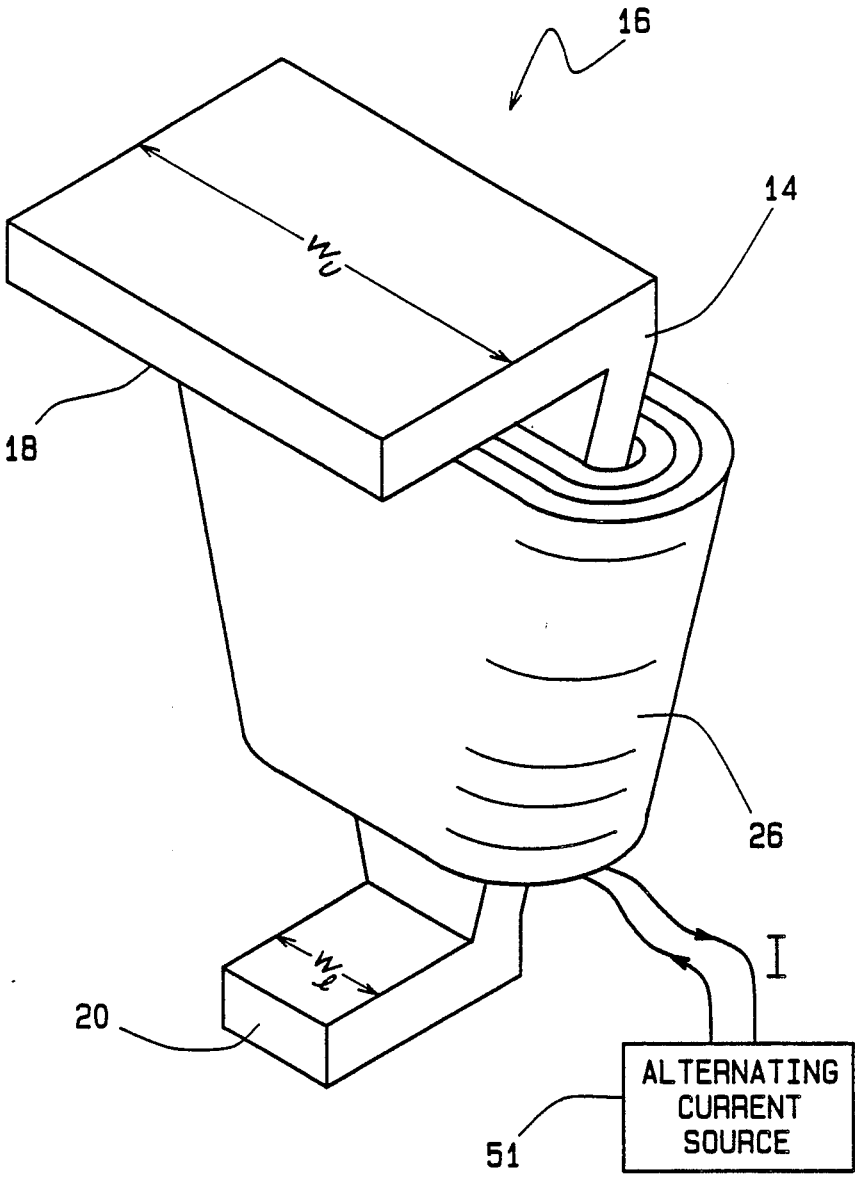
FIG. 3 is a perspective view of the magnet and coils.

Referring to FIG. 2 there is depicted a sectional view of the invention along the center line of FIG. 1 showing the arrangement of the magnet 16 with respect to rollers 10. Magnet 16 includes a yoke 14, upper pole 18, lower pole 20 and coil 26. Coil 26 is connected to an alternating current source 51 which provides an alternating current to the coil 26 thereby energizing magnet 16. The magnet 16 is made from a material, such as iron, having high magnetic permeability and low power loss for alternating magnetic fields. The upper pole 18 has a larger face area than the lower pole 20, as shown in FIG. 3 ($w_u > w_l$), so that the magnet 16 produces a field strength proportional to the square root of the distance downward from the top surface of the molten metal 12. The upper pole 18 and lower pole 20 should be generally sized so that the field generated between them satisfies Equation 4, above. Since the objective of the invention is to keep the molten metal 12 from the edge of the rollers 10, it is not critical that the vertical component of the field, $B_y$, changes exactly as $h^{\frac{1}{2}}$. The field can be larger, $B_y > k\ h^{\frac{1}{2}}$, which would cause a greater force to press the metal away from the magnet. This, however, would only cause the width of the solidified sheet 20 to be slightly smaller than what it would be if $B_y$ varied exactly as $h^{\frac{1}{2}}$.

Heat shield 27 between the molten metal 12 and the magnet 16 absorbs radiated heat from the metal 12 and protects coil 26 from excessive heat. Heat shield 27 may be made of copper and water cooled with cooling coil 31. Heat shield 27 can be shaped so as to adjust the cross-sectional area perpendicular to the flux so that the flux density, B, is of the desired value.

Heat generated in the magnet 16 by the alternating magnetic field is removed by heatsink 28 which also may be water cooled and made of copper. Heatsink 28 encloses the magnet 16 except for a gap that prevents the heat-sink 28 from becoming a shorted turn. If heatsink 28 is made of a low resistivity material, such as copper, it may also serve the purpose of preventing magnetic flux from leaving the magnet core assembly except at the poles 18 and 20. Additional cooling can be provided by providing a circulating water cooling system within the coil 26.

Referring again to FIG. 2, in operation, the magnetic field, B, generates eddy currents in the "skin" of the molten metal. These eddy currents form horizontal closed loops in the metal and interact with the vertical magnetic field thereby producing a horizontal force, F, in the skin of the molten metal 12 that presses the molten metal in a direction away from the magnet 16.

FIG. 3 depicts a perspective view of the magnet 16 and coil 26 of this embodiment of the invention. Upper pole 18 is wider than lower pole 20 so that the field is stronger at the lower pole where larger confinement forces are necessary.

Figure 4:
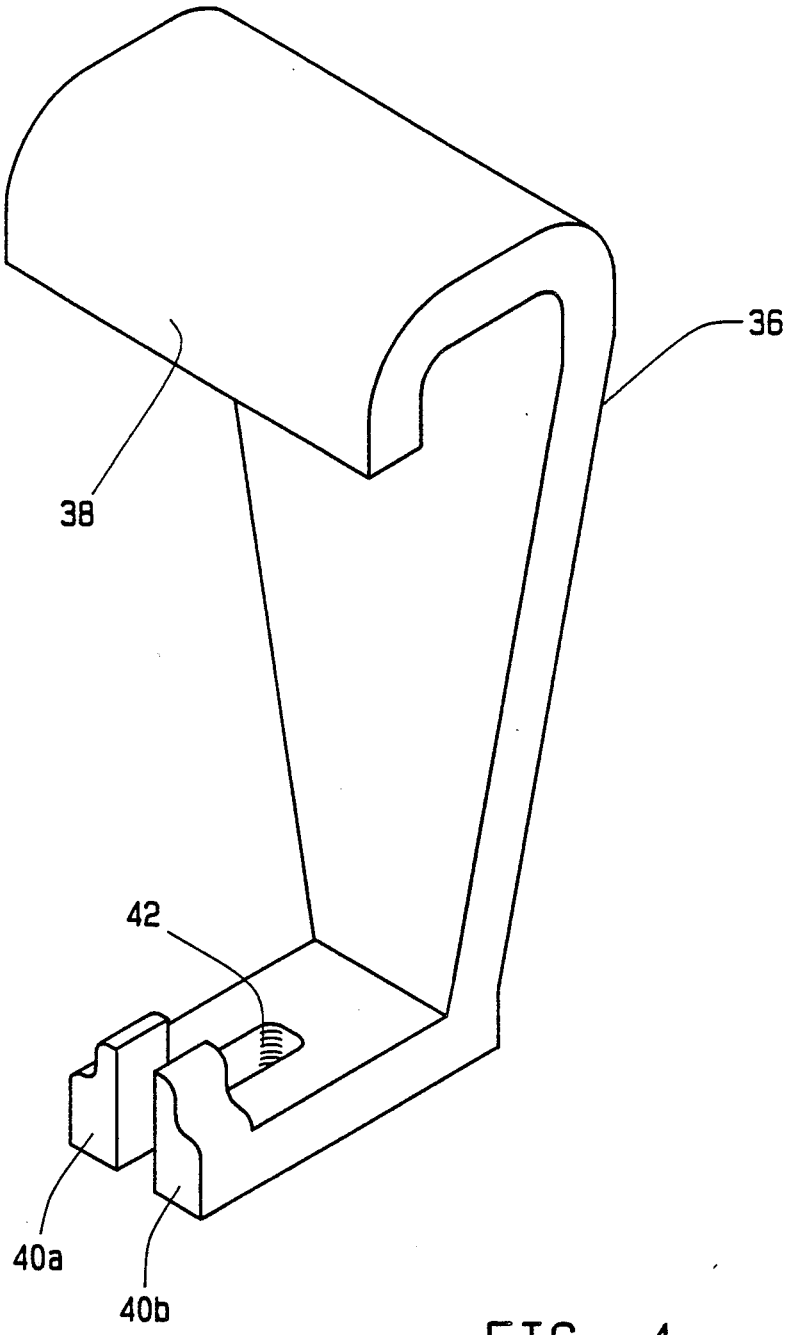
FIG. 4 is a perspective view of another embodiment of the magnet.

A second embodiment of the magnet invention is shown in FIG. 4. In this embodiment, the lower pole comprises a pair of lower pole prongs **40*a* and 40*b* of magnet 36 on either side of a slot 42 through which the cast metal sheet 22 can pass. This enables the lower pole prongs 40 to be positioned directly below upper pole 38. The field generated between the upper and lower poles is perpendicular to the axis of the rollers. As in the previous embodiment, low resistivity heat shield and sinks (not shown in FIG. 4) not only control the temperature of the magnet assembly, they also restrict the external magnetic field to be between upper pole 38 and lower pole prongs 40 so that no leakage flux leaves the magnet core. The ratio of the face areas of upper pole 38 and lower pole prongs 40 must be adjusted to satisfy Equation 4**.

Figure 5:
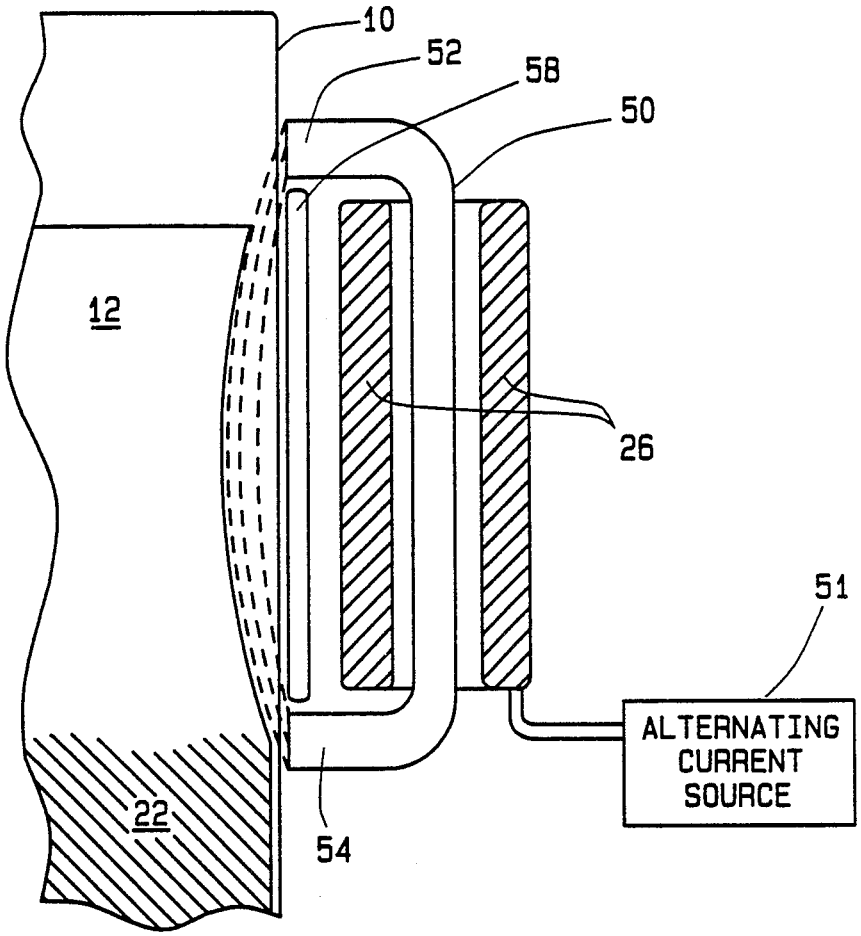
FIG. 5 is a sectional view along the center line of another embodiment of this invention.

A third embodiment of this invention, shown in FIG. 5, has a magnet assembly 50 with poles 52 and 54 that do not protrude into the space above the molten metal 12 or below the rollers 10. Magnet 50 including upper pole 52 and lower pole 54 is located adjacent to the edge of the rollers 10 and molten metal pool 12. The faces of upper pole 52 and lower pole 54 do face in the direction of the pool 12 and the vertical magnetic field between them will extend horizontally into the region of the pool thereby containing it between the rollers. The shield plate 58 is again shaped to adjust the flux density to the desired value. This arrangement makes the magnet assembly less susceptible of coming in contact accidently with the molten metal 12 or solidified metal 22. However, this magnet has a larger fringing field.

Figure 6:
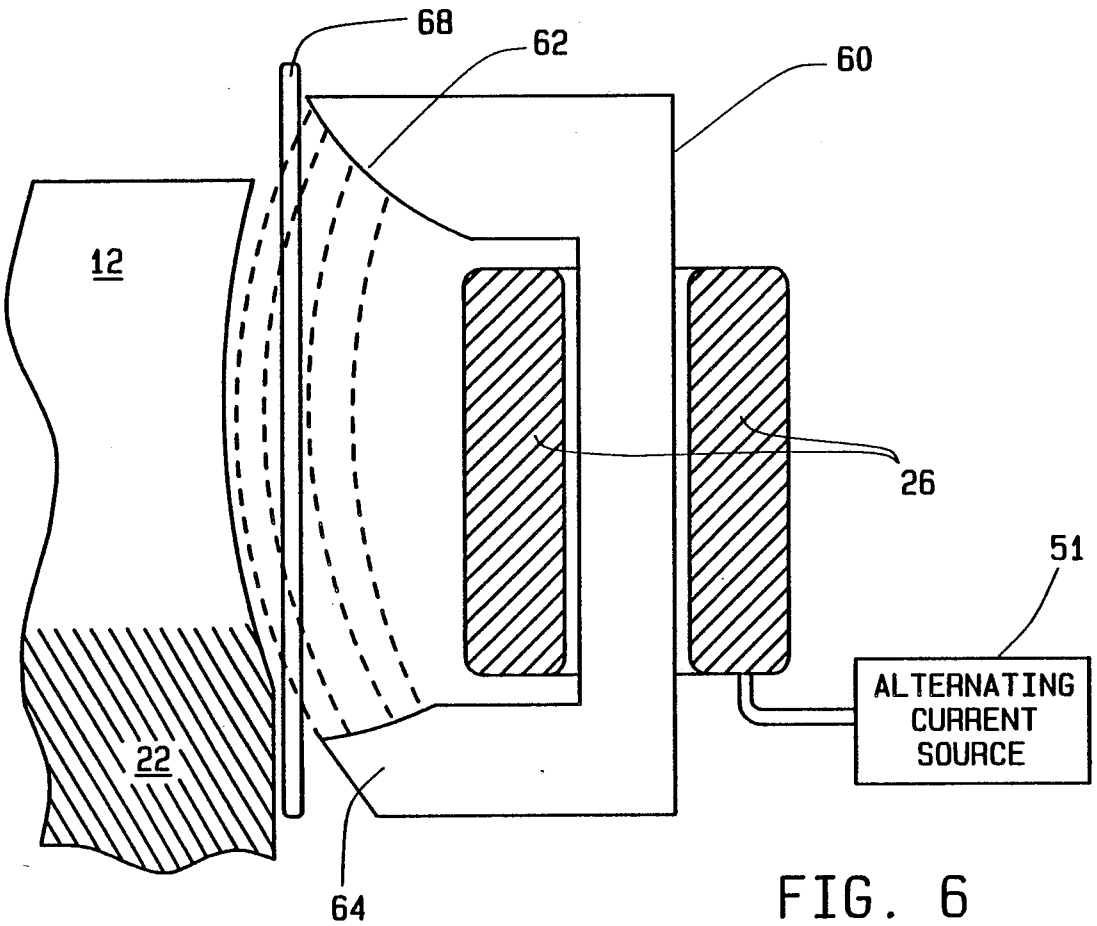
FIG. 6 is a sectional view along the center line of still another embodiment of this invention.

A fourth embodiment of this invention, shown in FIG. 6, has a square shaped magnet assembly 60 with poles 62 and 64. Similar to the previous embodiment, this embodiment features upper and lower poles that do not protrude into the space above the molten pool 12 or below rollers 10. This embodiment uses the shaped poles 62 and 64 and coil 26 to produce the desired field. This embodiment includes a shield 68 which is used to protect the magnet 60 from heat. Shield 68 must be made of a material transparent to the magnet field, such as ceramic. This embodiment is depicted without the low resistivity shields needed for cooling the magnet and confining and shaping the field, although it is understood that these features would normally be included.

Although the description of the embodiments so far herein discussed refer to vertical casting, the present inventions can be adapted to casting in any direction. If used for other than vertical casting, the strength of the magnetic field must vary in the vertical direction to offset the force of gravity as described before. As long as this condition is satisfied, the invention may be configured so that the steel sheet travels at any arbitrary angle including horizontal. Horizontal casting orientation may be desirable for practical considerations, such as building design or adaptation to existing layouts.

The present invention is described in terms of casting steel strip or sheet. The method is equally applicable to other metals such as aluminum, aluminum alloys, copper, copper alloys, etc., but not limited to these, and other shapes.

All of the previous described embodiments have the advantage that they contain the sides of a pool of metal, lying between two rollers, without physical contact to either the metal or the rollers. Electromagnetic containment provides a tight seal without the disadvantages of mechanical seals such as mechanical wear on the seal and drums, high friction losses, maintenance, heat transfer by conduction and leaks.

Figure 7:
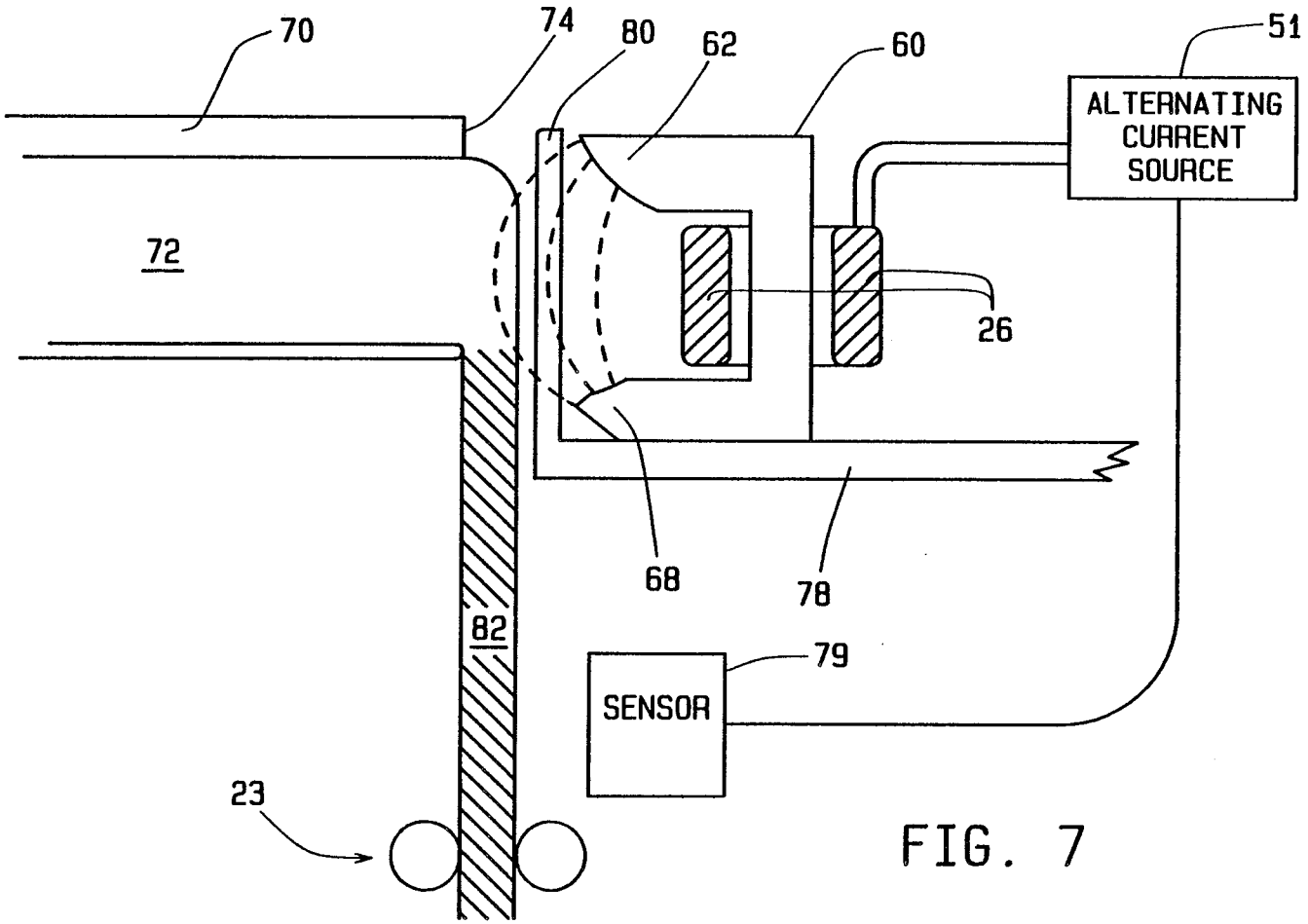
FIG. 7 is a side view of yet another embodiment of this invention.

The vertical magnetic field containment means of the present invention may be readily adapted to other configurations where it is desirable to regulate the flow of molten metal and at the same time avoid high frictional contact. Accordingly, the vertical magnetic field containment means of the present invention may be adapted to metal casting systems other than roller casting. An embodiment of an alternate casting system of the present invention is depicted in FIG. 7. FIG. 7 shows a magnet 60 used to regulate or stop the flow of molten metal 72 from the end of a channel 70 having open end 74. The magnet 60 contains poles 62 and 68 and coil 26 and shaped pole faces. Magnet 60 produces a vertical alternating magnetic field between poles 62 and 68 in accordance with Equations 1–4, above. Therefore, magnet 60 provides a vertical frictionless casting mold wall to confine a molten metal as in the previous embodiments. A heat shield 80 protects the magnet 60 from the heat of the molten metal 72. The magnet 60 and shield 80 are mounted on a movable platform 78, which is free to move predominantly in the horizontal direction. As platform 78 moves away from channel 70, the width available for flow of the molten metal 72 increases, and the flow increases. As platform 78 moves closer to channel 70, the width decreases. If the distance between channel 70 and platform 78 becomes small enough, the flow will stop.

Alternatively, the flow can be regulated by changing the current in coil 26 without moving the platform 78. The width or flow rate inside or outside the channel would be determined by a sensor 79 which would pass a signal to the current control means 81. The current control means 81 would control the current supplied by current source 51 to the coil 26 thereby modifying the strength of the magnet 60. The field from magnet 60 must cover the opening 74 of channel 70 in a vertical direction. The shape of the opening is arbitrary. Although channel 70 is shown with a closed top, the top may be open.

Figure 8A:
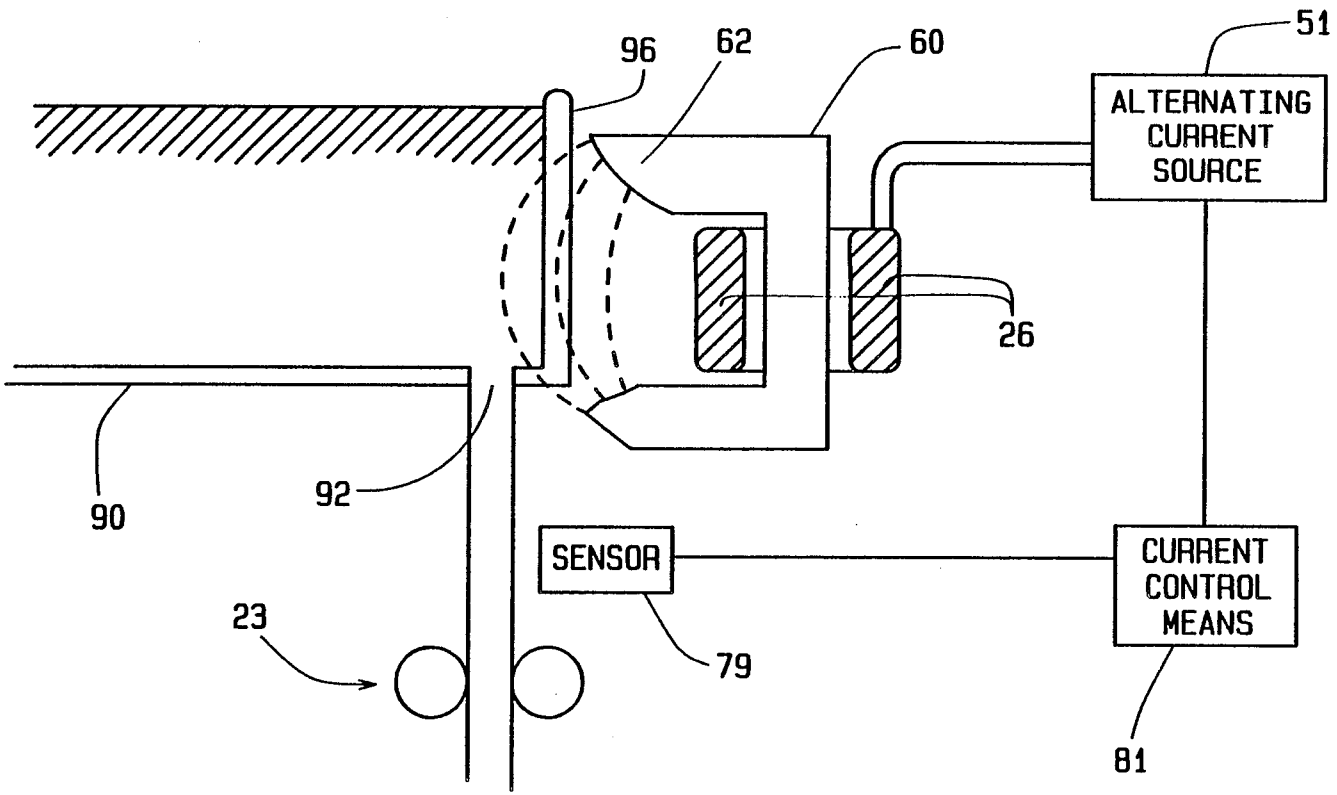
FIGS. 8*a* and 8*b* depict still another embodiment of this invention.
Figure 8B:
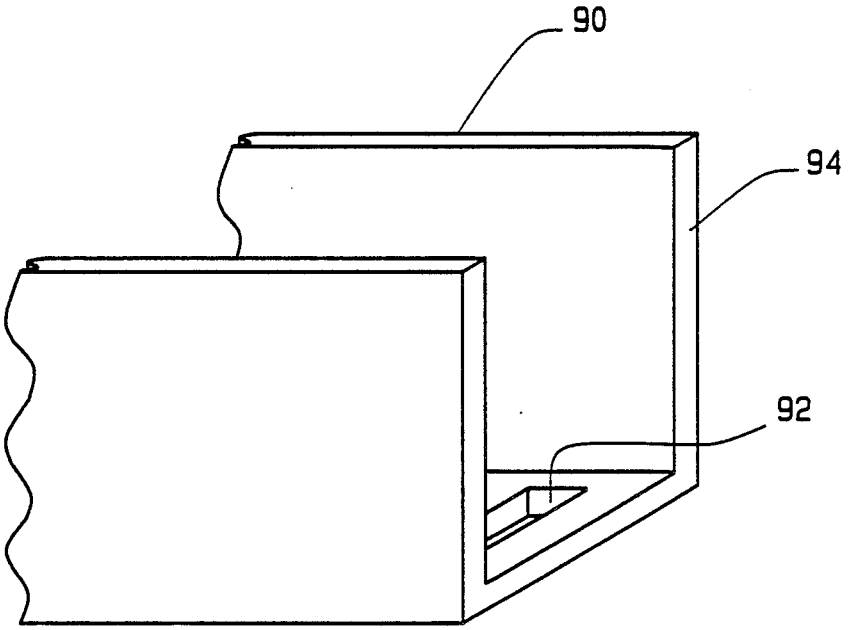

Another embodiment of the channel of the previous embodiment is shown in FIG. 8*a* where the channel 90 contains a slot or opening 92 in the bottom of the channel near one end 96 of channel 90. The end 96 of channel 90 must accommodate passage of a magnetic field. Therefore, it must be made of a magetically transparent material, such as ceramic. The magnet 60 is located adjacent the end 96 of the channel 92. Molten metal flowing through channel 90 passes through slot 92 and flows downward under the force of gravity. Flow through opening 92 is controlled by the magnetic field generated by magnet 60 by regulating the fraction of the opening 92 that is available to the molten metal. A variation of the slotted channel 90 of this embodiment is depicted in FIG. 8*b*. In FIG. 8*b*, the channel 90 is depicted with an open end 94 adjacent to the slot 92 in the channel bottom. As in the discussion for the previous embodiment either movement of the magnet or a change in the current through the coil will control the flow.

These latter two embodiments provide the advantage that the flow regulator is provided by a magnet field which has no physical contact with the molten metal or with the channel walls. As in the other embodiments, use of the magnetic field to contain the molten metal provides a frictionless contact which has the advantage of avoiding sticking of the flow regulator.

the embodiments of this invention in which an exclusive property or privilege is claimed are defined as follows:

1. In a system for continuous roller casting of a solid sheet of metal including a pair of rollers adjacent to one another and separated by a gap, said pair of rollers adapted to receive a pool of molten metal and to force molten metal between said pair of rollers by counter rotation of said pair of rollers to cast said molten metal into a solid sheet, the improvement comprising:

magnet means including a pair of magnets located adjacent to opposite ends of a pair of rollers and capable of generating an alternating vertical magnetic field thereby generating eddy currents in the skin of said molten metal, said eddy currents being the only electric currents generated in said molten metal and said eddy currents interacting with said alternating vertical magnetic field to produce a horizontal force in the skin of said molten metal, said force pressing said molten metal in a direction away from said alternating vertical magnetic field thereby preventing flow of said molten metal beyond said ends of said rollers, wherein the field generated by said magnet means satisfies the equation:

$$B=(2u_o g\rho h)^{\frac{1}{2}}$$

where $U_o$ is the permeability of free space, g is the acceleration of gravity, $\rho$ is the density of the metal, and h is the downward distance from the surface of said pool of molten metal.

2. The system of claim 1 wherein each of said pair of magnets comprises:

an upper pole located adjacent to one end of said pair of rollers, a lower pole located adjacent to the same end of said pair of rollers and below said upper pole, a yoke connecting said upper pole and said lower pole, and a coil around said yoke, said coil capable of being responsive to an alternating current source.

3. The system of claim 2 including roller cooling means integral with each of said pair of rollers capable of cooling and thereby tending to solidify said molten metal in contact with said pair of rollers.

4. The system of claim 3 including heat shielding means located around said magnet to protect said magnet from heat.

* * * * *